US005279537A

United States Patent [19]

Lile

[11] Patent Number: 5,279,537

[45] Date of Patent: Jan. 18, 1994

[54] CUFFING FINGER AND APPARATUS FOR CUFFING BAGS IN CARTONS

[75] Inventor: Richard R. Lile, Spokane, Wash.

[73] Assignee: R. A. Pearson Company, Spokane, Wash.

[21] Appl. No.: 41,478

[22] Filed: Apr. 2, 1993

[51] Int. Cl.[5] ..... B31B 7/74

[52] U.S. Cl. ..... 493/100; 493/294; 493/907; 493/480; 53/175

[58] Field of Search ..... 493/100, 217, 294, 907, 493/472, 480; 53/175, 371.2, 371.3

[56] References Cited

U.S. PATENT DOCUMENTS

| | | | |
|---|---|---|---|
| 3,606,821 | 9/1971 | Tsien . | |
| 3,796,140 | 3/1974 | Adams et al. | 93/32 |
| 4,083,293 | 4/1978 | Goldstein | 493/100 |
| 4,142,453 | 3/1979 | Gidewall et al. | 93/36.01 |
| 4,522,012 | 6/1985 | Nelson | 53/175 |
| 4,687,462 | 8/1987 | Rewitzer | 493/100 |
| 4,729,209 | 3/1988 | Owensby et al. | 53/434 |
| 4,829,741 | 5/1989 | Langen | 53/175 |
| 5,100,370 | 3/1992 | Barbour | 493/100 |

FOREIGN PATENT DOCUMENTS

| | | | |
|---|---|---|---|
| 1242225 | 12/1960 | France | 53/175 |

*Primary Examiner*—Jack Lavinder
*Attorney, Agent, or Firm*—Wells, St. John, Roberts, Gregory & Matkin

[57] ABSTRACT

A cuffing assembly for flexible bags inserted into a receiving open carton includes cuffing fingers at each carton corner. The fingers are movable between a retracted position for insertion into a bag and an extended position in which they can overlap the carton corners. Air is discharged through air outlets adjacent the outer ends of the cuffing fingers to minimize frictional forces between the bag and cuffing fingers to prevent tearing of the bag as the cuff is being formed and during subsequent retraction of the cuffing fingers.

9 Claims, 3 Drawing Sheets

CUFFING FINGER AND APPARATUS FOR CUFFING BAGS IN CARTONS

TECHNICAL FIELD

This disclosure pertains to machinery for expanding and inserting empty flexible bags into an open carton. It specifically pertains to an improved cuffing finger and associated air supply for cuffing an open end of a bag about the opening of a receiving carton.

BACKGROUND OF THE INVENTION

This invention pertains to formation of a cuff about the opening of a plastic bag used as a liner for a receiving open carton. It arose from a need to facilitate the insertion and removal of cuffing fingers without tearing a bag during and after formation of the cuff. Such lined carton assemblies are widely used for packing of fresh meat and other food products.

The present disclosure constitutes an improvement in bag cuffing equipment of the type generally disclosed in U.S. Pat. No. 5,100,370, issued Mar. 31, 1992, which is hereby incorporated into this description by reference.

BRIEF DESCRIPTION OF THE DRAWINGS

A preferred embodiment of the invention is illustrated in the accompanying drawings, which are briefly described below.

DETAILED DESCRIPTION OF THE PREFERRED EMBODIMENTS

This disclosure of the invention is submitted in furtherance of the constitutional purposes of the Patent Laws "to promote the progress of science and useful arts" (Article 1, Section 8).

The present improvement can be utilized in a variety of machines designed for inserting bags into open cartons. The present improvements pertain to the structure and operation of cuffing fingers, such as those described in the U.S. Pat. No. 5,100,370. The improved cuffing fingers are applicable to any bag cuffing assembly using insertable cuffing fingers to invert the bag opening about the open periphery of a receiving carton. While disclosed specifically in relation to the previously-patented dual cuffing fingers, this improvement is not to be limited to any particular cuffing finger configuration. One familiar with the present development of bag inserter machinery will readily understand the application of the present improvements to such equipment.

Figure 1:
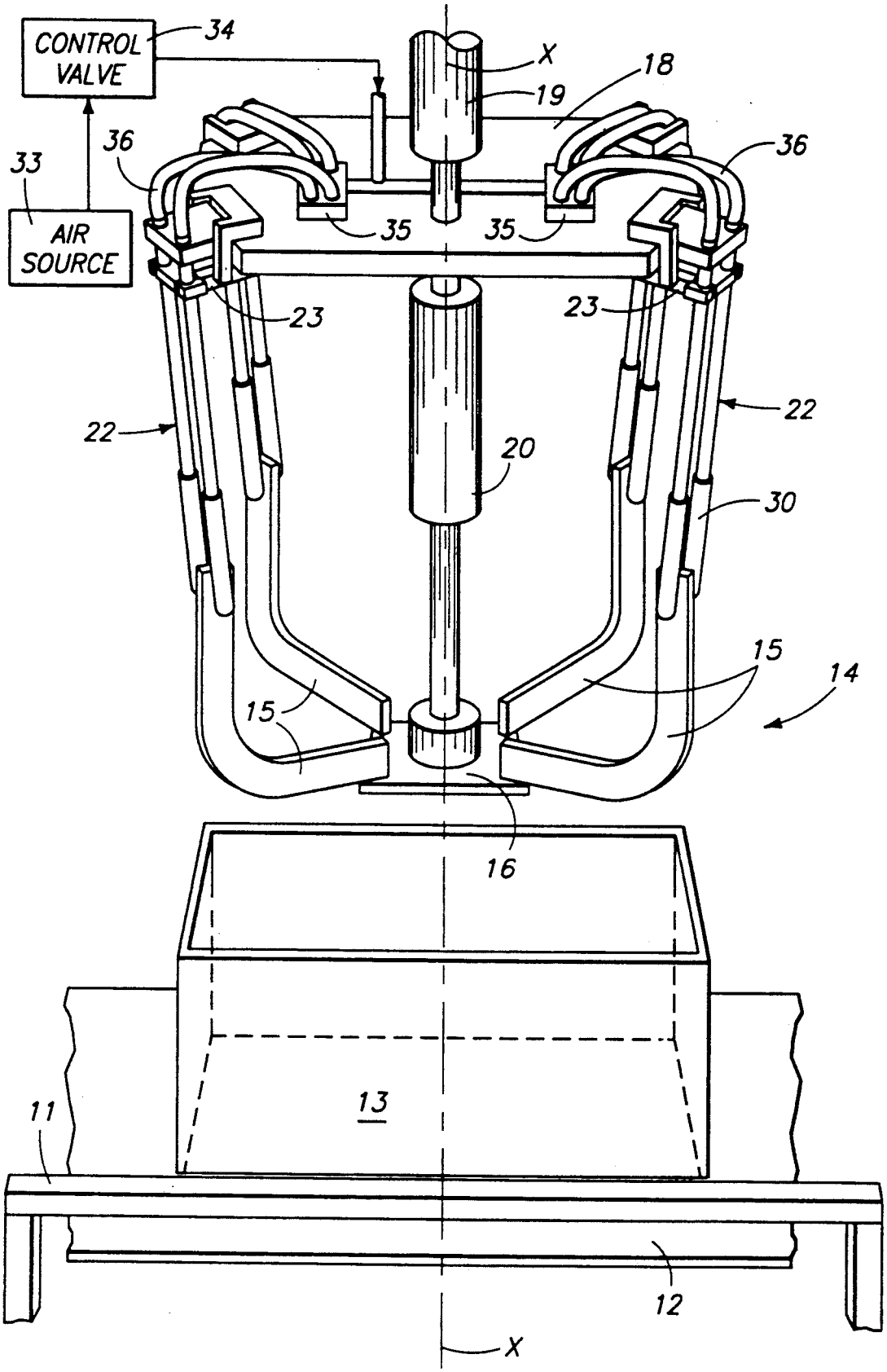
FIG. 1 is a simplified perspective view of a bag insertion apparatus modified according to the present invention.

This invention can best be understood from a review of the machine components shown in FIG. 1. The inserting and cuffing apparatus is mounted on a supporting machine framework. Incoming open cartons 13 are fed along framework 10 by a powered conveyor 12. They are guided between stationary rails 11 fixed to the framework.

Each open carton 13 is individually aligned in a stationary loading position facing a movable mandrel 14. The mandrel is insertable progressively into an open bag 17 and the facing open carton 13 axially aligned with the mandrel. After the bag reaches the bottom of the carton, the open end of the bag is cuffed about the perimeter of the open carton in preparation for loading of product.

Mandrel 14 is shown as being constructed from a plurality of diagonal plates 15 adapted to individually bisect the corners of a receiving carton 13. Each plate 15 includes an open vertical leg and an integral horizontal leg extending inwardly across the outer or bottom end of mandrel 14. The four plates illustrated in FIG. 1 are joined to one another at a central block 16 to form a unitary mandrel structure conforming to the shape and size of the interior surfaces of a receiving carton 13.

The open upper end of each bag 17 is cuffed about the carton by movable cuffing fingers 22 located axially inward from the mandrel 14. A pair of cuffing fingers 22 are provided along each corner of mandrel 14. Each pair of cuffing fingers 22 are arranged to span one corner of a receiving carton 13. The individual cuffing fingers in each pair are arranged at opposite sides of the respective mandrel plates 15. They move inwardly and outwardly in directions parallel to the adjacent plates 15 as they pivot relative to axes perpendicular to the plates.

Actuating means is operably connected to each pair of cuffing fingers 22 for selectively moving the individual cuffing fingers between a retracted position and extended position. The actuating means is illustrated by small cylinders 23 connected by linkages to the paired fingers 22, which in turn are pivotally connected at their upper ends to a supporting movable frame 18. The retracted position is located within the exterior confines of mandrel 14 to facilitate initial placement of the mandrel 14 and cuffing fingers 22 within a receiving bag 17 in preparation for subsequent insertion of the bag 17 within a receiving carton 13. While in the extended position, each finger 22 overlaps an outer side wall of a receiving carton at locations adjacent to its corners. The extended position of each cuffing finger 22 spreads the open end of the bag 17 and inverts the open end of the bag over the top edges of the carton 13 as the bag 17 is inserted within it. The extended fingers 22 produce a surrounding "cuff" about the carton opening, with the upper edge of the bag 17 facing upwardly about the periphery of the extended fingers 17.

Frame 18 is vertically movable relative to framework 10 by means of a main cylinder 19 operably connected between them. The housing of cylinder 19 is fixed to framework 10. Its reciprocating piston is mounted to frame 18 at its lower end.

A secondary cylinder 20 is operably connected between frame 18 and mandrel 14. The upper end of the cylinder housing is fixed to the frame 18. The lower end of its piston rod is fixed to the center block 16 of mandrel 14. The entire inserting and cuffing assembly is centered along a mandrel axis illustrated in FIG. 1 by the line X—X.

Figure 6:
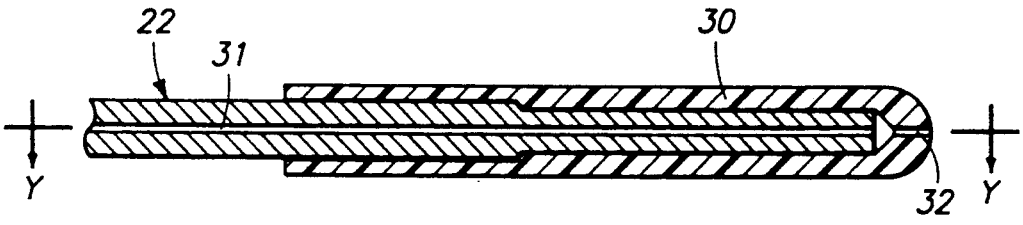
FIG. 6 is an enlarged cross-sectional view through the center of the modified cuffing finger.

The improvements to the cuffing fingers 22 are shown in FIGS. 1 and 6. Each cuffing finger 22 is formed as an elongated rod centered along a straight axis Y—Y. The rod can be made from any suitable material, such as metal or plastic. It should be substantially rigid, and is preferably cylindrical in shape. Its outer end is covered by a plastic sleeve 30 having a rounded end to minimize tearing of bags. The rod includes an axial central bore, shown at 31, which serves as a conduit for compressed air delivered to the cuffing finger to reduce friction about the cuffing finger as a bag is engaged by it.

An axial aperture 32 is formed through the outer end of sleeve 30 in alignment with the bore 31. The end opening of bore 31 and the aperture 32 form an air outlet adjacent to the outer end of the rod for discharge of air into a bag as a cuff is being formed.

While a single axial air outlet is illustrated at the end of each cuffing finger, it is to be understood that other forms of air outlets are applicable to this invention. As examples, the rod (and sleeve 30) might be provided with a plurality of air openings along their outer ends, or the sleeve 30 might be porous to distribute air in a film about its surface areas in contact with a bag. The precise manner in which air is discharged at the outer end of each cuffing finger is largely a matter of choice and machine design.

Compressed air can be supplied to the individual cuffing fingers 22 from a suitable air source 33 and control valve 34 by distribution manifolds 35 and supply hoses 36 located on the mandrel 14 (see FIG. 1).

The discharge of compressed air through each cuffing finger 22 creates an air film between the contacting sleeves 30 and the bag surfaces as the cuff is being formed. This significantly decreases the frictional forces imparted to the plastic film and reduces tearing. It also facilitates escape of the cuffing fingers 22 from formed cuff as the mandrel 14 is retracted at the completion of cuff formation.

While the discharge of air can be continuous during operation of the cuffing mechanism, it is preferable to program operation of valve 34 to supply air to the outer ends of cuffing fingers 22 while the cuffing fingers 22 are in their extended positions substantially parallel to axis X—X.

The method of inserting and cuffing bags to line a rectangular carton according to this invention is diagrammatically illustrated in FIGS. 2–5.

Figure 2:
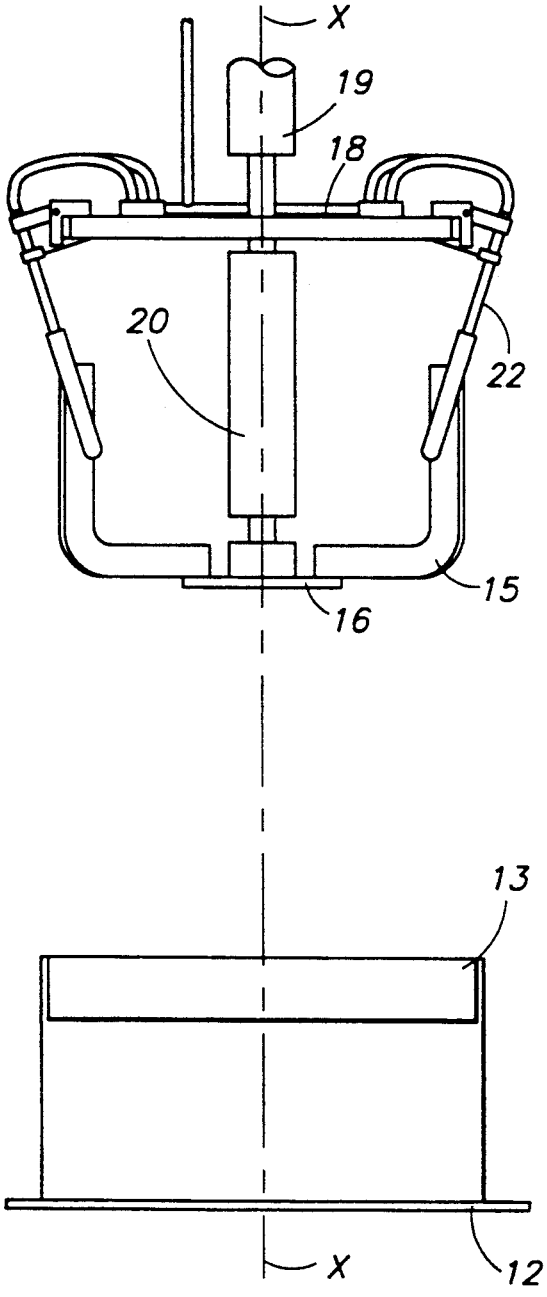
FIG. 2 is a diagrammatic elevation view showing the elements of the invention prior to receipt of a bag.

FIG. 2 shows the above-described components in their initial positions prior to placement of a bag about the mandrel 14.

Figure 3:
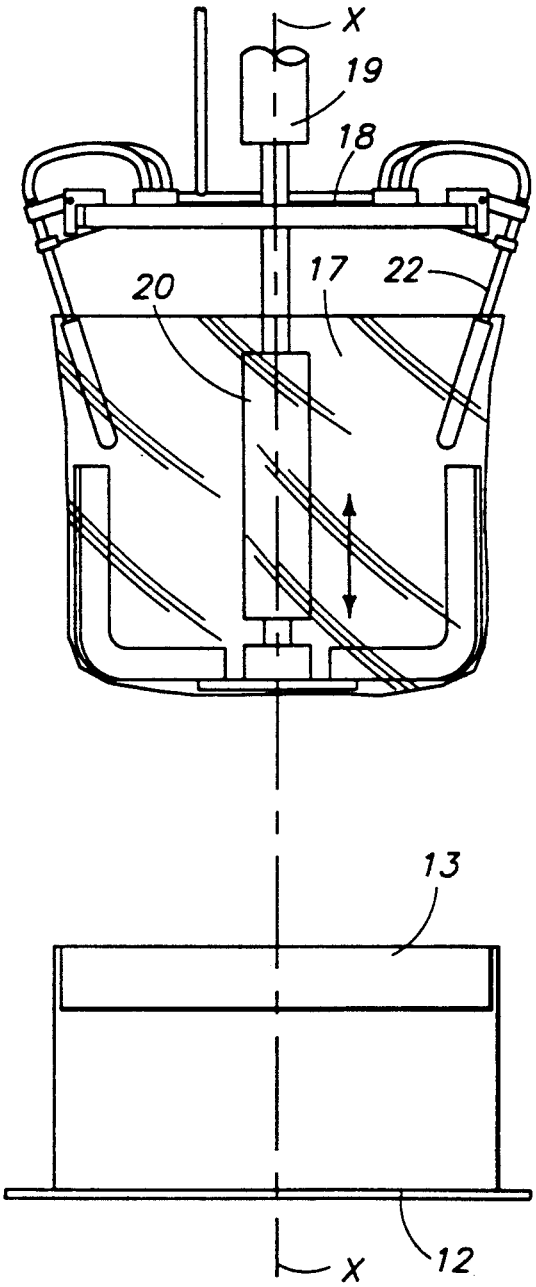
FIG. 3 is a view similar to FIG. 2, showing initial engagement of a bag by the mandrel and retracted fingers.

Operation of the apparatus is initiated by activating main cylinder 19 to lower the frame 18 and extended mandrel 14 downwardly, placing the mandrel 14 within an open bag 17 as it approaches the awaiting carton 13 on conveyor 12 (FIG. 3). During this movement, the lower ends of the fingers 22 slightly overlap the upper ends of the mandrel plates 15. The fingers 22 are in their retracted positions radially within the confines of the mandrel 14 and are located within the interior of bag 17.

Figure 4:
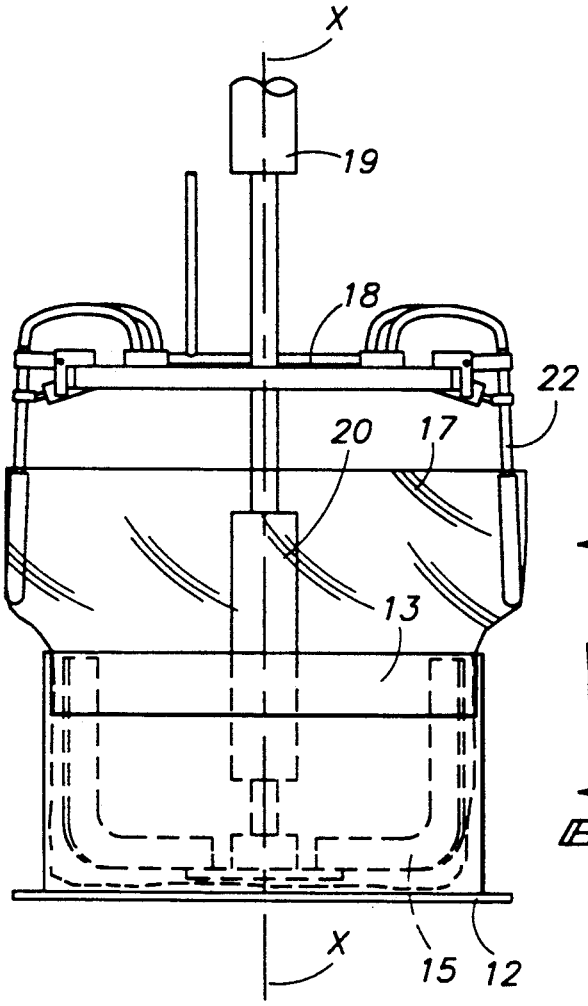
FIG. 4 is a view similar to FIG. 2, showing the mandrel inserted into the receiving carton and the bag opening being spread by the extended fingers.

FIG. 4 shows the bag 17 fully inserted within carton 13. When the bottom edges of mandrel 14 engage the bottom of the carton 13, the secondary cylinder 20 is actuated to retract its piston and shorten the distance between the bottom of mandrel 14 and the frame 18, which continues to move downwardly. When mandrel 14 reaches the bottom of carton 13, the actuator cylinders 23 are powered to pivot fingers 22 to their extended positions (parallel to axis X—X). In these positions, the fingers 22 are aligned outwardly along the outer surfaces of the carton sides. Operation of valve 34 should be timed to initiate discharge of air through the cuffing fingers 22 simultaneously with this motion.

Figure 5:
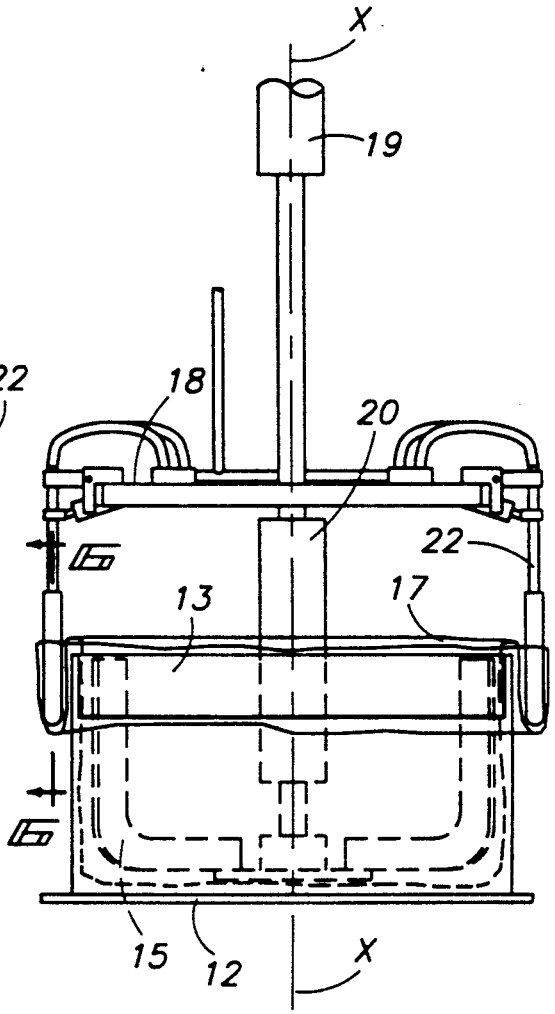
FIG. 5 is a view similar to FIG. 2, showing completion of the cuffing operation.

FIG. 5 shows completion of the cuffing operation, which occurs as the fingers 22 push downwardly along the opening of bag 17 to invert it over the top edges of the carton 13 and the bottom ends of the fingers 22.

After completion of the inserting and cuffing operations as shown in FIG. 5, the secondary cylinder 20 is expanded to remove fingers 22 from within the cuffed bag opening. They are then retracted. The continuing supply of discharged air about the cuffing fingers 22 assures smooth removal of the cuffing fingers 22 from the cuffed bag without tearing. Main cylinder 19 is subsequently activated to remove mandrel 14 from within the lined carton 13.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An apparatus for cuffing the open end of a flexible bag over the top edges of a rectangular carton into which the bag is inserted as a liner, comprising:

a mandrel insertable progressively into an open bag and a facing open carton axially aligned with the mandrel;

a plurality of cuffing fingers arranged on the mandrel in a pattern corresponding to the corners of a receiving carton, each cuffing finger including an air outlet;

actuating means operably connected to each cuffing finger for selectively moving it between a retracted position to facilitate initial placement of the mandrel and cuffing fingers within a bag in preparation for subsequent insertion of the bag within a receiving carton, and an extended position in which the cuffing fingers spread the open end of the bag to thereby cause the bag to span the corners of the carton and invert the open end of the bag over the top edges of the carton as the bag is inserted within it; and air supply means connected to the cuffing fingers for selectively discharging air from the air outlets of the cuffing fingers while they are in their extended positions.

2. The apparatus of claim 1, wherein each cuffing finger comprises:

a rigid elongated rod having an outer end adapted to be inserted within a bag during formation of a cuff;

the air outlet on the cuffing finger being located adjacent to its outer end for discharge of air into a bag as a cuff is being formed.

3. The apparatus of claim 1, wherein the cuffing finger comprises:

a rigid elongated rod having an axial central bore; and a sleeve covering the outer end of the rod;

the air outlet being in the form of an open aperture formed through the rod and sleeve in open communication with the bore.

4. A cuffing finger adapted for use in cuffing the open end of a flexible bag over the top edges of a rectangular carton into which the bag is inserted as a liner, comprising:

a rigid elongated rod having an outer end adapted to be inserted within a bag during formation of a cuff about a receiving open carton; and an air outlet adjacent to the outer end of the rod for discharge of air into a bag as a cuff is being formed.

5. The cuffing finger of claim 4, wherein the rod has an axial central bore in open communication with its air outlet.

6. The cuffing finger of claim 4, wherein the rod includes an axial central bore, the cuffing finger further comprising:

a sleeve covering the outer end of the rod;

the air outlet being in the form of an open aperture formed through the rod and sleeve in open communication with the bore.

7. A cuffing finger assembly adapted for use in cuffing the open end of a flexible bag over the top edges of a rectangular carton into which the bag is inserted as a liner, comprising:

a rigid elongated rod having an outer end adapted to be inserted within a bag during formation of a cuff about a receiving open carton; and an air outlet adjacent to the outer end of the rod for discharge of air into a bag as a cuff is being formed;

the rod having an axial central bore in open communication with its air outlet; and air supply means operably connected to the bore within the rod for selectively directing air through the bore and to the air outlet.

8. The cuffing finger assembly of claim 7, wherein the air outlet is an axial central aperture in open communication with the bore.

9. A method for lining a rectangular carton having four corners arranged about a peripheral opening by inserting a closed end of a flexible bag into the carton and cuffing an opposite open end of the bag over the carton opening in preparation for loading of the lined carton, comprising the following steps:

inserting a mandrel into a flexible bag and engaging the interior of a closed end of the bag;

positioning an open carton in a loading position facing the mandrel;

shifting the mandrel and a surrounding bag into an open carton at the carton loading position;

actuating a plurality of cuffing fingers arranged at each corner of a receiving carton to selectively move the cuffing fingers between retracted positions to facilitate initial placement of the mandrel and cuffing fingers within a receiving bag in preparation for insertion of the bag within a receiving carton, and extended positions in which the cuffing fingers are adapted to spread the open end of the bag and overlap the corners of a receiving carton and to invert the open end of the bag over the top edges of the carton as the bag is inserted within it by reciprocation of the mandrel; and discharging air through the cuffing fingers to reduce frictional contact between the cuffing fingers and the bag surfaces while the cuffing fingers are in their extended positions.

* * * * *